US008444503B2

(12) United States Patent
Kumamoto

(10) Patent No.: US 8,444,503 B2
(45) Date of Patent: May 21, 2013

(54) GOLF CLUB HEAD

(75) Inventor: Tomio Kumamoto, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 424 days.

(21) Appl. No.: 12/766,750

(22) Filed: Apr. 23, 2010

(65) Prior Publication Data

US 2010/0311518 A1 Dec. 9, 2010

(30) Foreign Application Priority Data

Jun. 3, 2009 (JP) ..... 2009-133639

(51) Int. Cl.
*A63B 53/04* (2006.01)

(52) U.S. Cl.
USPC ..... 473/324; 473/330; 473/331

(58) Field of Classification Search
USPC ..... 473/324–350, 287–292
See application file for complete search history.

(56) References Cited

U.S. PATENT DOCUMENTS

| | | | | |
|---|---|---|---|---|
| 1,525,137 | A * | 2/1925 | Lawton | 473/330 |
| 1,536,616 | A * | 5/1925 | Manning | 473/331 |
| 4,508,349 | A * | 4/1985 | Gebauer et al. | 473/330 |
| 4,858,929 | A * | 8/1989 | Long | 473/290 |
| 5,688,186 | A * | 11/1997 | Michaels et al. | 473/290 |
| 6,733,400 | B2 * | 5/2004 | Sherwood | 473/290 |
| 6,814,673 | B2 * | 11/2004 | Wahl et al. | 473/331 |
| 7,014,568 | B2 * | 3/2006 | Pelz | 473/287 |
| 7,056,226 | B2 * | 6/2006 | Kennedy | 473/330 |
| 7,156,751 | B2 * | 1/2007 | Wahl et al. | 473/331 |
| 7,179,175 | B2 * | 2/2007 | Kennedy, III | 473/330 |
| 7,641,570 | B2 * | 1/2010 | Yokota | 473/331 |
| 7,749,099 | B2 * | 7/2010 | Ban et al. | 473/331 |
| 7,780,548 | B2 * | 8/2010 | Solheim | 473/330 |
| 7,798,917 | B2 * | 9/2010 | Nguyen et al. | 473/330 |

(Continued)

FOREIGN PATENT DOCUMENTS

| | | | |
|---|---|---|---|
| JP | 9-70457 | A | 3/1997 |
| JP | 10-179824 | A | 7/1998 |
| JP | 2008-161658 | A | 7/2008 |

OTHER PUBLICATIONS

Japanese Office Action for Application No. 2009-133639 dated Jun. 28, 2011.

*Primary Examiner* — Sebastiano Passaniti
(74) *Attorney, Agent, or Firm* — Birch, Stewart, Kolasch & Birch, LLP

(57) ABSTRACT

A head 2 has a face line 8 having a depth of D1 (mm). In a section line of a surface of the face line 8, a boundary between a land area LA and the face line 8 is defined as a point Pa; a point of which a depth is [D¼] (mm) is defined as a point Pb; a point of which a depth is [D½] (mm) is defined as a point Pc; a point of which a depth is [(D1)×(¾)] (mm) is defined as a point Pd; a radius of a circle CL1 passing through three points of the point Pa, the point Pb, and the point Pc is defined as R3 (mm); a straight line passing through the point Pc and the point Pd is defined as a straight line Lcd; a straight line perpendicular to the land area LA is defined as a straight line Lp; and an angle between the straight line Lcd and the straight line Lp is defined as θm. At that time, the radius R3 is 0.01 (mm) or greater and 0.10 (mm) or less, and the angle θm is 40 degrees or greater and 70 degrees or less.

24 Claims, 13 Drawing Sheets

U.S. PATENT DOCUMENTS

| | | | | |
|---|---|---|---|---|
| 7,798,918 | B2 * | 9/2010 | Ban et al. | 473/330 |
| 7,824,279 | B2 * | 11/2010 | Ban et al. | 473/331 |
| 7,905,797 | B2 * | 3/2011 | Gilbert et al. | 473/287 |
| 7,922,601 | B2 * | 4/2011 | Ban et al. | 473/330 |
| 8,029,384 | B2 * | 10/2011 | Chen et al. | 473/331 |
| 8,062,149 | B2 * | 11/2011 | Ban | 473/330 |
| 8,210,966 | B2 * | 7/2012 | Gilbert et al. | 473/330 |
| 8,221,262 | B1 * | 7/2012 | Cackett et al. | 473/330 |
| 2007/0149312 | A1 | 6/2007 | Gilbert | |
| 2008/0167138 | A1 | 7/2008 | Ban et al. | |
| 2008/0171613 | A1 | 7/2008 | Gilbert et al. | |
| 2008/0242442 | A1 | 10/2008 | Gilbert et al. | |
| 2009/0264217 | A1 | 10/2009 | Johnson et al. | |
| 2009/0282670 | A1 | 11/2009 | Gilbert et al. | |
| 2009/0298609 | A1 | 12/2009 | Gilbert et al. | |
| 2009/0313806 | A1 | 12/2009 | Gilbert | |
| 2010/0056295 | A1 * | 3/2010 | Ban et al. | 473/331 |

* cited by examiner

GOLF CLUB HEAD

This application claims priority on Patent Application No. 2009-133639 filed in JAPAN on Jun. 3, 2009, the entire contents of which are hereby incorporated by reference.

BACKGROUND OF THE INVENTION

1. Field of the Invention

The present invention relates to a golf club head having face lines.

2. Description of the Related Art

Face lines are formed on many golf club heads. The face lines can contribute to increase in a backspin rate of a hitting ball. The face lines can suppress fluctuation in the backspin rate.

In golf in case of rain, a face impacts a ball with water present between the face and the ball. The water can reduce friction between the face and the ball. The face lines can suppress the influence of the water. In other words, the face lines can enhance spin performance in a wet condition.

In the case of shot from the rough, the face impacts the ball with grass (lawn grass) present between the face and the ball. The grass can reduce the friction between the face and the ball. The reduction in the friction may cause reduction in the backspin rate. A phenomenon in which the backspin rate is reduced is referred to as flier. The flier complicates the control of a flight distance. The face lines can contribute to the suppression of the flier. Since the grass is cut by the face lines, the flier can be suppressed.

On the other hand, the face lines may damage the ball. The damage includes also fine splitting. While the face lines having a sharp edge can contribute to increase in a spin amount, the face lines are apt to damage the ball.

Japanese Patent Application Laid-Open No. 2008-206984 (US2007/0149312 A1) discloses a shape of a face line capable of increasing a backspin rate.

SUMMARY OF THE INVENTION

The present invention has considered a section shape of a face line based on new technical concept. It was found that the face line can realize both suppression of a damage of a ball and spin performance.

A golf club head according to the present invention has a face line having a depth of D1 (mm) and a land area. A boundary between the land area and the face line in a section line of a surface of the face line is defined as a point Pa; a point of which a depth is [D¼] (mm) is defined as a point Pb; a point of which a depth is [D½] (mm) is defined as a point Pc; and a point of which a depth is [(D1)×(¾)] (mm) is defined as a point Pd. A radius of a circle CL1 passing through three points of the point Pa, the point Pb, and the point Pc is defined as R3 (mm). A straight line passing through the point Pc and the point Pd is defined as a straight line Lcd. A straight line perpendicular to the land area is defined as a straight line Lp. An angle between the straight line Lcd and the straight line Lp is defined as θm. The radius R3 is 0.01 (mm) or greater and 0.10 (mm) or less. The angle θm is 40 degrees or greater and 70 degrees or less.

Preferably, the section line is smoothly continuously formed between the point Pa and the point Pd.

Preferably, a maximum value Zm of a deviation distance between the section line of the point Pa to the point Pc and the circle CL1 is equal to or less than 0.05 mm.

The present invention can realize both the suppression of the damage of the ball and the spin performance.

DESCRIPTION OF THE PREFERRED EMBODIMENTS

The present invention will be described below in detail based on preferred embodiments with reference to the drawings.

Figure 1:
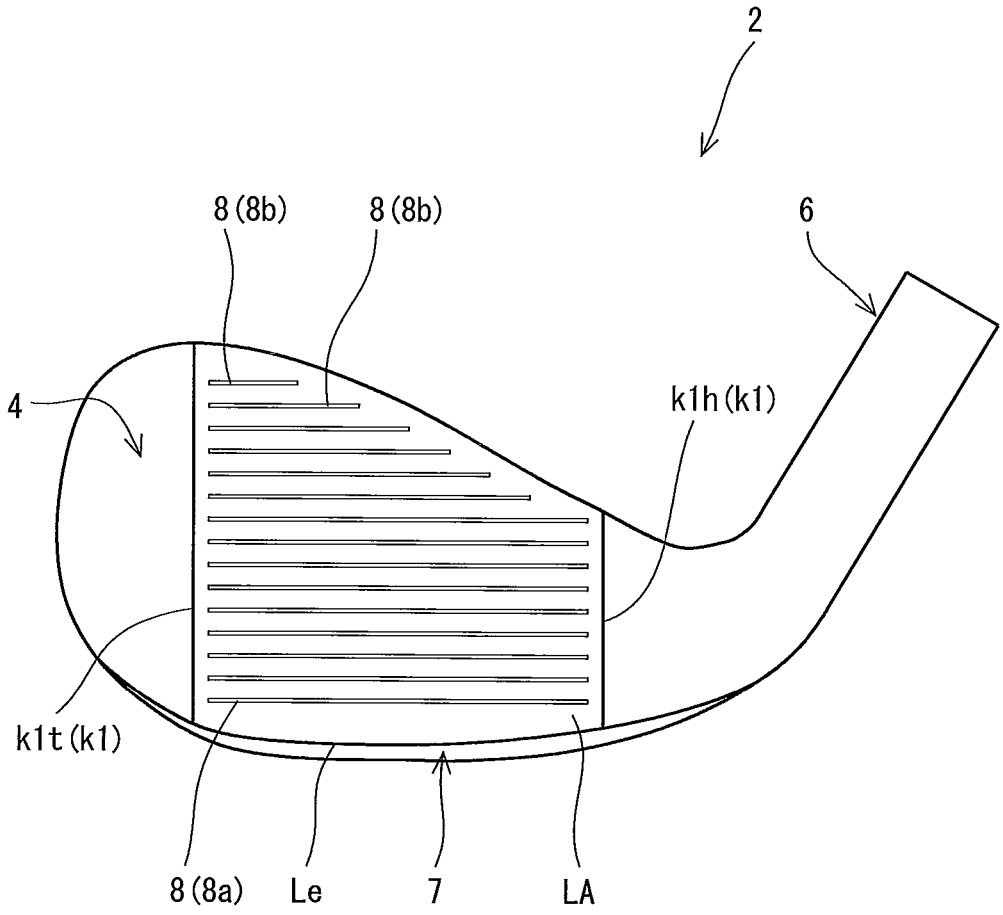
FIG. 1 is a diagram of a golf club head according to one embodiment of the present invention, as viewed from a face side.
Figure 2:
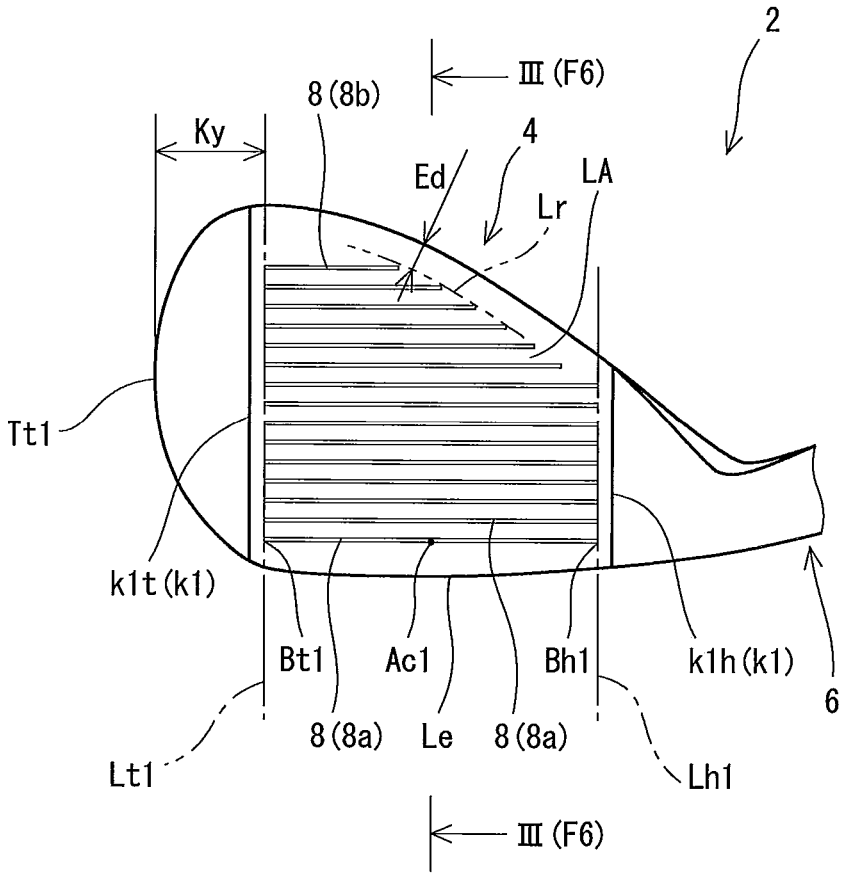
FIG. 2 is a diagram of the head of FIG. 1, as viewed from a position facing a face surface.

In FIG. 1, a head 2 is placed at a predetermined lie angle and real loft angle on a level surface. FIG. 2 is a diagram of the head 2, as viewed from a direction facing a face surface 4.

The golf club head 2 is a so-called iron type golf club head. The head is also referred to as an iron head. The head is for right-handed golfers. The golf club head 2 is a so-called wedge. The real loft angle of the wedge is usually 43 degrees or greater and 70 degrees or less.

The head 2 has a face 4, a hosel 6, and a sole 7. The face 4 has a face line 8 formed thereon. The golf club head 2 has a shaft hole (not shown) to which a shaft is mounted. The shaft hole is formed in the hosel 6.

A material of the head 2 and the face 4 is not restricted. The face 4 may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include CFRP (carbon fiber reinforced plastic).

The head 2 has the plurality of face lines 8. The face lines 8 are grooves. In the present application, the face lines 8 are also referred to as grooves. The face lines 8 are constituted by the longest lines 8*a* having the longest length and non-longest lines 8*b* shorter than the longest lines 8*a*. The lengths of the non-longest lines 8*b* are shorter as getting closer to a top side.

Toe side ends of the longest lines 8*a* are substantially located on one straight line Lt1 (see FIG. 2). Heel side ends of the longest lines 8*a* are substantially located on one straight line Lh1 (see FIG. 2). The straight line Lt1 and the straight line Lh1 are shown by a one-dotted chain line in FIG. 2.

Toe side ends of the non-longest lines 8*b* are substantially located on one straight line Lt1, or are located on the heel side relative to the straight line Lt1. In the head 2 of the embodiment, the toe side ends of all the non-longest lines 8*b* are substantially located on one straight line Lt1. The toe side ends of the non-longest lines 8*b* may be located on the heel side relative to the straight line Lt1.

Heel side ends of the non-longest lines 8*b* are substantially located on one straight line Lh1, or are located on the toe side relative to the straight line Lh1. Usually, the heel side ends of the non-longest lines 8*b* are located on the toe side relative to the straight line Lh1 as in the embodiment of FIG. 2. The heel side ends of the non-longest lines 8*b* are located on a line Lr (see FIG. 2) almost along the contour of the face 4. A distance Ed (see FIG. 2) between each of the heel side ends of the non-longest lines 8*b* and an edge of the face 4 is almost constant.

The face 4 has a land area LA. The land area LA indicates a portion of a surface (face surface) of the face 4 on which the grooves are not formed. If fine unevenness formed by a shot-blasting treatment or the like to be described later is disregarded, the land area LA is substantially a plane. When a section shape is considered in the present application, the land area LA shall be a plane.

A part of the face 4 is subjected to a treatment for adjusting a surface roughness. The typical example of the treatment is the shot-blasting treatment. The treatment will be described later. A boundary line k1 between an area which is subjected to the shot-blasting treatment and an area which is not subjected to the shot-blasting treatment is shown in FIGS. 1 and 2. An area between a toe side boundary line k1*t* and a heel side boundary line k1*h* is subjected to the shot-blasting treatment. All the face lines 8 are formed in the area which is subjected to the shot-blasting treatment. A toe side area relative to the toe side boundary line k1*t* is not subjected to the shot-blasting treatment. A heel side area relative to the heel side boundary line k1*h* is not subjected to the shot-blasting treatment. The toe side boundary line k1*t* and the heel side boundary line k1*h* are visually recognized by the absence or presence of the shot-blasting treatment. The shot-blasting treatment can increase the surface roughness. The increased surface roughness can increase the backspin rate of a ball. The increase in the backspin rate tends to stop the ball near the point of fall. The increase in the backspin rate can facilitate the stopping of the ball at the aiming point. The increase in the backspin rate is particularly useful for a shot targeting a green and an approach shot.

As shown in FIG. 2, the straight line Lt1 and the boundary line k1*t* are substantially parallel. The straight line Lh1 and the boundary line k1*h* are substantially parallel. The straight line Lt1, the boundary line k1*t*, the straight line Lh1, and the boundary line k1*h* are substantially parallel.

The toe side boundary line k1*t* is located on the toe side of the straight line Lt1. The heel side boundary line k1*h* is located on the heel side of the straight line Lh1.

The face surface may be polished before processing the face lines 8. The face surface of a head 2*p* before the face lines 8 are formed can be smoothed by polishing the face surface.

The face surface may be polished after processing the face lines 8. The land area LA can be flattened by polishing the face surface. A roundness may be applied to the edge of the face line 8 by the polishing.

A treatment (the shot-blasting treatment described above, or the like) for adjusting a surface roughness may be carried out before processing the face lines 8. The treatment for adjusting the surface roughness may be carried out after processing the face lines 8

Figure 3:
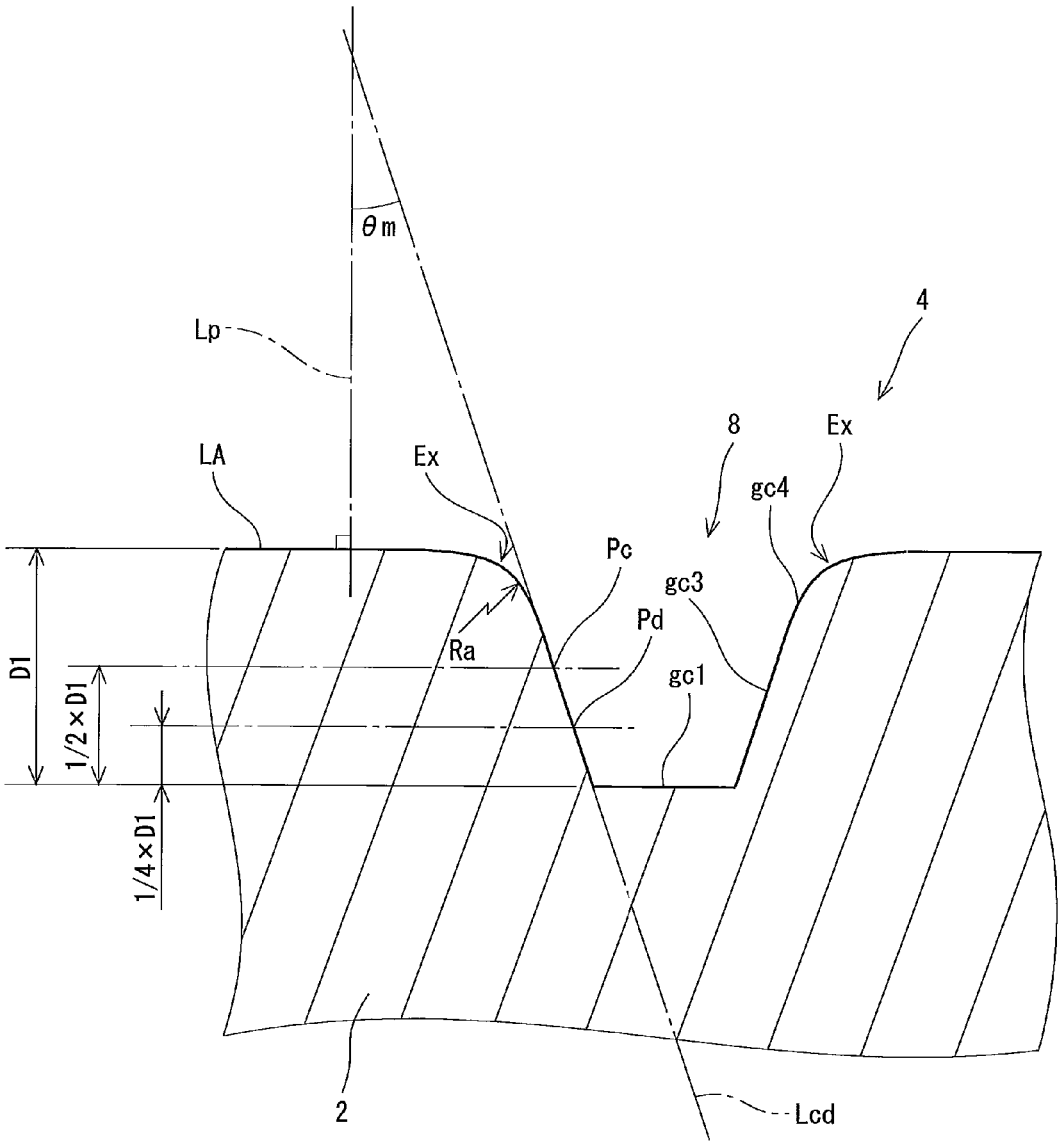
FIG. 3 is a diagram in which a part of a section taken along a line of FIG. 2 is expanded.

FIG. 3 is a sectional view taken along a line of FIG. 2. FIG. 3 is an enlarged view showing only one face line 8.

As shown in FIG. 3, the face line 8 has a bottom surface gc1, a plane inclined part gc3, and a protruded curved surface gc4. The whole or a part of the protruded curved surface gc4 is an edge Ex.

The bottom surface gc1 is a plane. The plane is parallel to the land area LA. The bottom surface gc1 may not be a plane. For example, the bottom surface gc1 may be a curved surface, or may be an inclined surface. In respect of enlarging an area A1 (described later) of a transverse plane of a groove to enhance spin performance, the bottom surface gc1 is preferably a plane.

The plane inclined part gc3 may be present, or may not be present. In respect of enlarging the area A1 (described later) of the transverse plane of the groove to enhance the spin performance, it is preferable that the plane inclined part gc3 is present.

Figure 4:
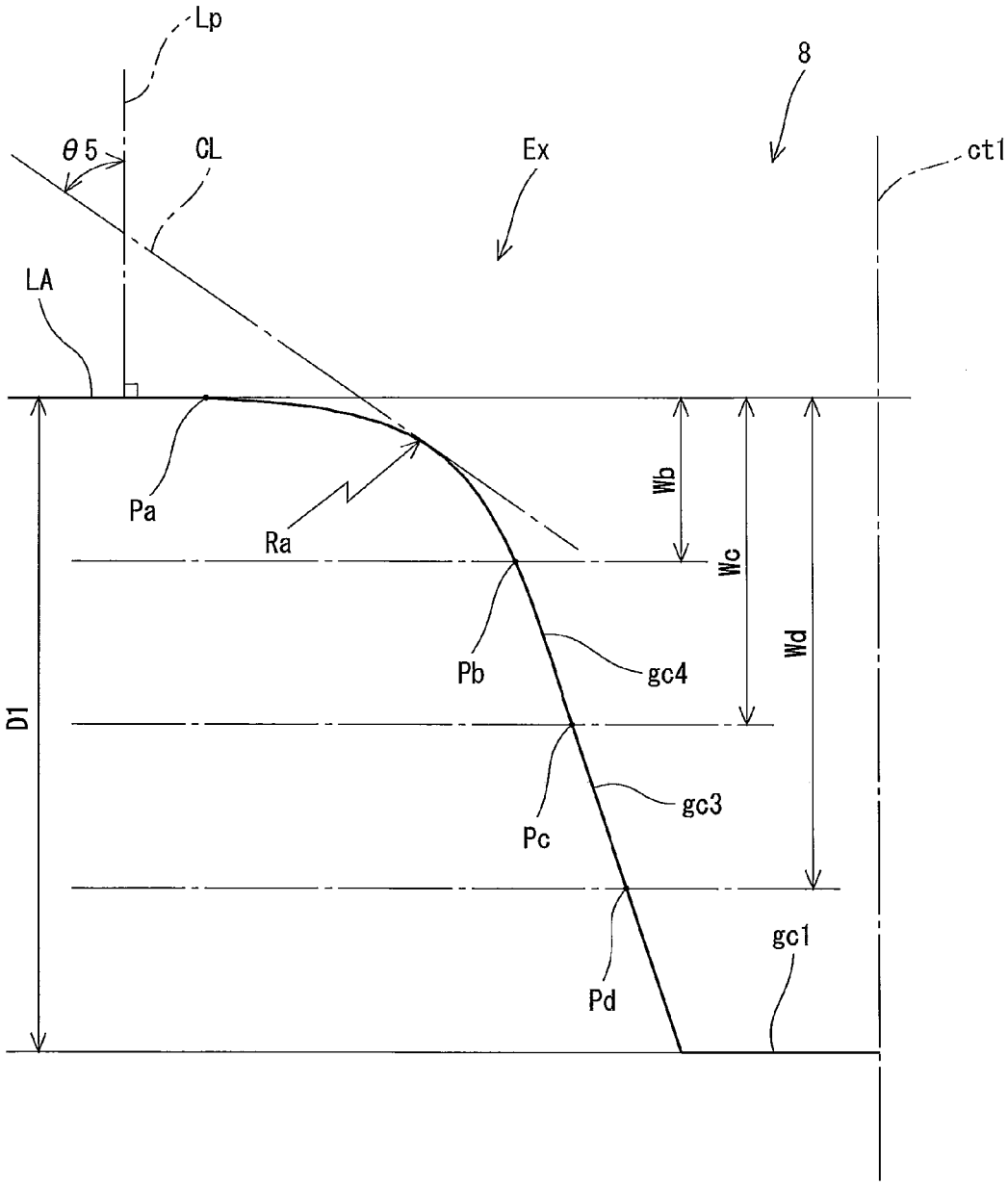
FIG. 4 is a diagram in which a section line of FIG. 3 is expanded.
Figure 5:
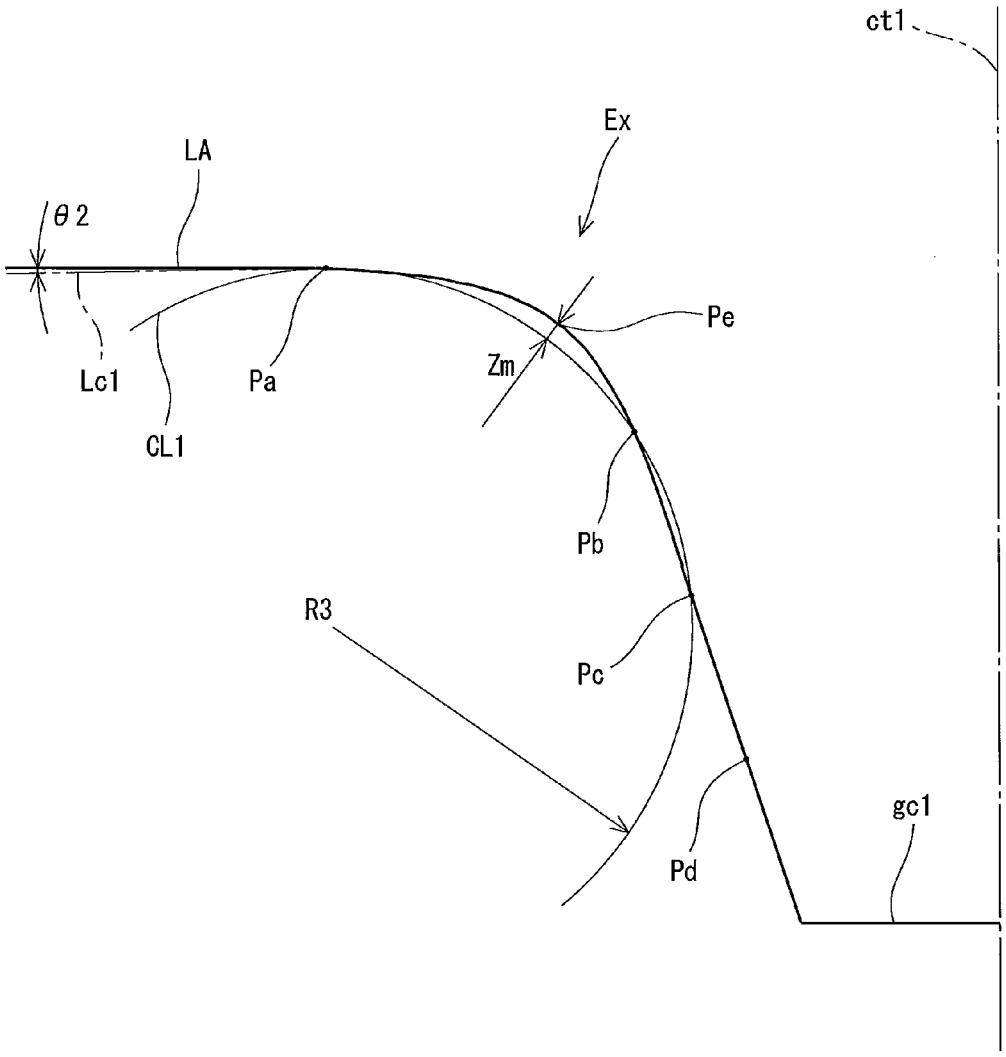
FIG. 5 is a diagram in which the section line of FIG. 3 is expanded as in FIG. 4.

FIGS. 4 and 5 are enlarged views showing a section line of a surface of the face line 8. The section shape of the face line 8 is symmetrical. The section shape of the face line 8 is axisymmetric about a central line ct1. Only the left side portion of the central line ct1 is shown in FIGS. 4 and 5.

In the present application, the section line of the surface of the face line or the section line of the surface of the land area LA is merely also referred to as a "section line".

In the embodiment, the entire protruded curved surface gc4 is smoothly continuously formed. At least a part of the protruded curved surface gc4 may not be smoothly continuously formed. In respect of suppressing the damage of the ball, it is preferable that the entire protruded curved surface gc4 is smoothly continuously formed.

The protruded curved surface gc4 and the land area LA are smoothly continuously formed. The protruded curved surface gc4 and the land area LA may not be smoothly continuously formed. In respect of suppressing the damage of the ball, it is preferable that the protruded curved surface gc4 and the land area LA are smoothly continuously formed. In other words, it is preferable that the edge Ex and the land area LA are smoothly continuously formed.

The protruded curved surface gc4 and the plane inclined part gc3 are smoothly continuously formed. The protruded curved surface gc4 and the plane inclined part gc3 may not be smoothly continuously formed.

In the present application, a point Pa, a point Pb, a point Pc, and a point Pd are defined. The point Pa, the point Pb, the point Pc, and the point Pd are points present on the surface of the face line 8. The point Pa, the point Pb, the point Pc and the point Pd are points present on the section line of the surface of the face line 8.

An upper end point of the edge Ex of the face line 8 is the point Pa (see FIG. 4). The point Pa is a boundary between the land area LA and the face line 8.

A groove depth (mm) is shown by a double-pointed arrow D1 in FIG. 4. The groove depth D1 is a distance between the deepest point of the bottom surface gc1 and the land area LA. The groove depth D1 is measured along a direction perpendicular to the land area LA.

A point placed at a position of which a depth is ¼ of the groove depth D1 is the point Pb (see FIG. 4). In other words, a depth Wb of the point Pb is [D¼] (mm).

A point placed at a position of which a depth is ½ of the groove depth D1 is the point Pc (see FIG. 4). In other words, a depth Wc of the point Pc is [D½] (mm).

A point placed at a position of which a depth is ¾ of the groove depth D1 is the point Pd (see FIG. 4). In other words, a depth Wd of the point Pd is [(D1)×(¾)] (mm).

The depth Wb, the depth Wc, and the depth Wd are measured along a direction perpendicular to the land area LA.

In respect of golf rules, the groove depth (the depth of the face line) D1 (mm) is preferably equal to or less than 0.508 (mm), more preferably equal to or less than 0.480 (mm), and still more preferably equal to or less than 0.460 (mm). When the groove depth D1 is excessively small, an area A1 (described later) of a transverse plane of a groove is reduced, whereby the spin performance may be reduced. In this respect, the groove depth D1 is preferably equal to or greater than 0.100 (mm), more preferably equal to or greater than 0.200 (mm), and still more preferably equal to or greater than 0.250 (mm).

In the present application, a radius R3 is defined.

The radius R3 is a radius of a circle CL1 passing through the point Pa, the point Pb, and the point Pc (see FIG. 5). A part of circle CL1 is drawn in FIG. 5.

In respect of the spin performance, the radius R3 is preferably equal to or less than 0.100 (mm), more preferably equal to or less than 0.090 (mm), and still more preferably equal to or less than 0.080 (mm). In respect of enhancing dischargeability of water and dischargeability of earth and sand, the radius R3 is preferably equal to or greater than 0.010 (mm).

The dischargeability of water implies the degree of discharge of water included in the groove out of the groove. The water included in the groove may reduce the spin performance. The groove having good dischargeability of water can have excellent spin performance in a wet condition.

The dischargeability of earth and sand implies the degree of discharge of earth and sand included in the groove out of the groove. The earth and sand included in the groove may reduce the spin performance. Particularly, amateur golf players are more apt to duff a shot. In the duffing shot, the earth and sand hit the face immediately before impact. The earth and sand may intrude into the face line. The face line including the earth and sand is apt to reduce the spin performance. The groove having good dischargeability of earth and sand can have excellent spin performance in the duffing shot.

In sand shot, shot for hitting a ball together with sand is intentionally carried out. The shot is also referred to as explosion shot. In the sand shot, the sand may intrude into the face line immediately before impact. The face line including the sand may reduce the spin performance. The groove having good dischargeability of earth and sand can have excellent spin performance in the sand shot.

The maximum value of a deviation distance between the section line of the point Pa to the point Pc and the circle CL1 is shown by a double-pointed arrow Zm in FIG. 5. The maximum deviation distance Zm is measured along the radial direction of the circle CL1.

In respect of enhancing the effect resulting from the definition of the radius R3, the maximum deviation distance Zm is preferably equal to or less than 0.05 (mm), more preferably equal to or less than 0.03 mm, and still more preferably equal to or less than 0.02 (mm).

In the embodiment of FIG. 5, a point Pe bringing about the maximum distance Zm is located between the point Pa and the point Pb. The constitution can contribute to increase in curvature radii in the point Pa and the point Pc. The constitution tends to cause the smooth continuousness of the point Pa to the point Pd. The constitution tends to bring the smoothness of the point Pa and the land area LA.

An angle θ1 between a tangent at the point Pa and the land area LA is not restricted. When a point Px on a section line located between the point Pa and the point Pb is considered, and a straight line Lax connecting the point Px and the point Pa is further considered in the case where the point Px approaches the point Pa unboundedly along the section line, the tangent at the point Pa implies a straight line that the straight line Lax approaches unboundedly.

In respect of suppressing the damage of the ball, the angle θ1 is preferably equal to or less than 30 degrees, more preferably equal to or less than 10 degrees, and still more preferably equal to or less than 5 degrees. Most preferably, the land area LA and the section line of the face line are smoothly continuously formed in the point Pa.

An angle θ2 (see FIG. 5) between a tangent Le1 of the circle CL1 at the point Pa and the section line of the land area LA is not restricted. In respect of suppressing the damage of the ball, the angle θ2 is preferably equal to or less than 30 degrees, more preferably equal to or less than 10 degrees, still more preferably equal to or less than 5 degrees, still more preferably equal to or less than 2 degrees, still more preferably equal to or less than 1 degree, and most preferably 0 degree. When θ2 is 0 degree, the land area LA and the section line of the face line tend to be smoothly formed or be in a state close to smoothness, in the point Pa.

A straight line passing through the point Pc and the point Pd is shown by a one-dotted chain line Lcd in FIG. 3. An angle between a straight line Lp perpendicular to the land area LA and the straight line Lcd is shown by θm in FIG. 3. The angle θm is measured in the section of the face line 8. In the present application, the θm is also referred to as a groove angle.

When the groove angle θm is excessively great, the area A1 (described later) of the transverse plane of the groove is apt to be excessively reduced. When the area A1 of the transverse plane of the groove is excessively small, a ball surface part is hard to be bitten into the face line. Therefore, when the area A1 of the transverse plane of the groove is small, the spin performance is apt to be reduced. In respect of increase in a spin amount, the groove angle θm is preferably equal to or less than 70 degrees, more preferably equal to or less than 68 degrees, and still more preferably equal to or less than 66 degrees.

When the groove angle θm is excessively small, the dischargeability of water and the dischargeability of earth and sand are apt to be reduced in the duffing shot and the sand shot. In these respects, the groove angle θm is preferably equal to or greater than 40 degrees, more preferably equal to or greater than 42 degrees, and still more preferably equal to or greater than 44 degrees.

It was considered that it is difficult to enhance the spin performance unless the radius R3 is reduced. On the other hand, it was found that the ball is apt to be damaged although enhancement in the spin performance is found when the radius R3 is small. The damage of the ball changes the surface shape of the ball. The shape change is apt to reduce the flight distance performance and controllability of the ball.

It was found that the radius R3 and the groove angle θm set to the values described above reduce the damage of the ball even when the radius R3 is small. It was found that the radius R3 and the groove angle θm set to the values described above can realize both the spin performance and the suppression of the damage of the ball. It was found that the radius R3 and the groove angle θm set to the values described above enhance the dischargeability of water and the dischargeability of earth and sand. Therefore, particularly, it was found that the spin performance can be enhanced in the wet condition or the duffing shot.

The curvature radius Ra at each of the points between the point Pa and the point Pb may be constant, or may not be constant. In respects of the damage of the ball, the dischargeability of water, and the dischargeability of earth and sand, it is preferable that the curvature radius Ra at each of the points between the point Pa and the point Pb is gradually increased as approaching to the point Pa. Although the straight line portion may be included between the point Pa and the point Pb, in respects of the damage of the ball, the dischargeability of water, and the dischargeability of earth and sand, it is preferable that the straight line portion is not included between the point Pa and the point Pb. In respects of the damage of the ball, the dischargeability of water, and the dischargeability of earth and sand, it is preferable that only a curved line is included between the point Pa and the point Pb.

The curvature radius Ra at each of the points between the point Pa and the point Pc may be constant, or may not be constant. The straight line portion may be included between the point Pa and the point Pc. In respects of the damage of the ball, the dischargeability of water, and the dischargeability of earth and sand, it is preferable that only a curved line is included between the point Pa and the point Pc.

The curvature radius Ra at each of the points between the point Pb and the point Pc may be constant, or may not be constant. The straight line portion may be included between the point Pb and the point Pc.

The curvature radius Ra at each of the points between the point Pc and the point Pd may be constant, or may not be constant. The straight line portion may be included between the point Pc and the point Pd. Only the straight line may be included between the point Pc and the point Pd.

In respects of the damage of the ball, the dischargeability of water, and the dischargeability of earth and sand, it is preferable that the point Pa to the point Pd is smoothly continuously provided. It is preferable that the straight line and/or the curved line are smoothly continuously provided between the point Pa and the point Pd.

In respect of suppressing the damage of the ball, it is preferable that the land area LA and the protruded curved surface gc4 are smoothly continuously formed.

In respects of the damage of the ball, the dischargeability of water, and the dischargeability of earth and sand, it is preferable that a tangent CL is present in all the points (excluding the point Pa and the point Pb) between the point Pa and the point Pb. An example of the tangent CL is shown in FIG. 4.

In respects of suppressing the damage of the ball, the dischargeability of water, and the spin performance, it is preferable that an angle θ5 between a tangent CL at each of the points between the point Pa and the point Pb and the straight line Lp is gradually or stepwisely reduced as approaching the point Pb. An example of the tangent CL and an example of the angle θ5 are shown in FIG. 4.

A formation method of the face line is not restricted. As the formation method of the face line, forging, press processing, casting and cutting processing (carving) are exemplified.

In the cutting processing, the cutting processing of the face line is carried out using the cutter. In the press processing, a face line mold which has a protruded part corresponding to the shape of the face line is used. The face line mold is forced on the face to form the face line. The face line mold in the press processing may be referred to as a "face line engraved mark" by a person skilled in the art.

In the case of the forging, the mold is inexpensive, and maintenances such as correction are also easy. On the other hand, in the case of the forging, a receiving jig for supporting the back side of the head is required. The receiving jig requires high accuracy. The heat treatment in the forging is apt to generate organization change. The organization change may cause strength reduction.

In the case of the forging, the face line mold is inexpensive, and maintenances such as correction are also easy. On the other hand, in the case of the press processing, a receiving jig for supporting the back side of the head is required. The receiving jig requires high accuracy.

Since the face line is also formed in the casting while the head is cast, there is less time and effort for forming the face line. However, the molten metal stream during the casting may cause a defect in the face line.

In respect of the accuracy of the section shape of the face line, the cut processing is most preferable.

In the cut processing, the edge of the face line is apt to be sharp. The edge is apt to damage the ball. In this respect, processing for rounding the edge may be carried out after the cut processing. Buff and shot blasting are exemplified as processing for rounding the edge. The buff is carried out, for example, by a wire brush. When processing for rounding the edge is carried out after the cut processing, the variation in the section shape of the face line is apt to occur. In this respect, it is preferable that the edge is rounded by the cut processing.

On the other hand, when the manufacture cost of the cutter is considered, preferably, the shape of the cutting surface of the cutter may be simple. In this respect, it is preferable that processing for rounding the edge is carried out after the cut processing as in examples to be described later.

Figure 6:
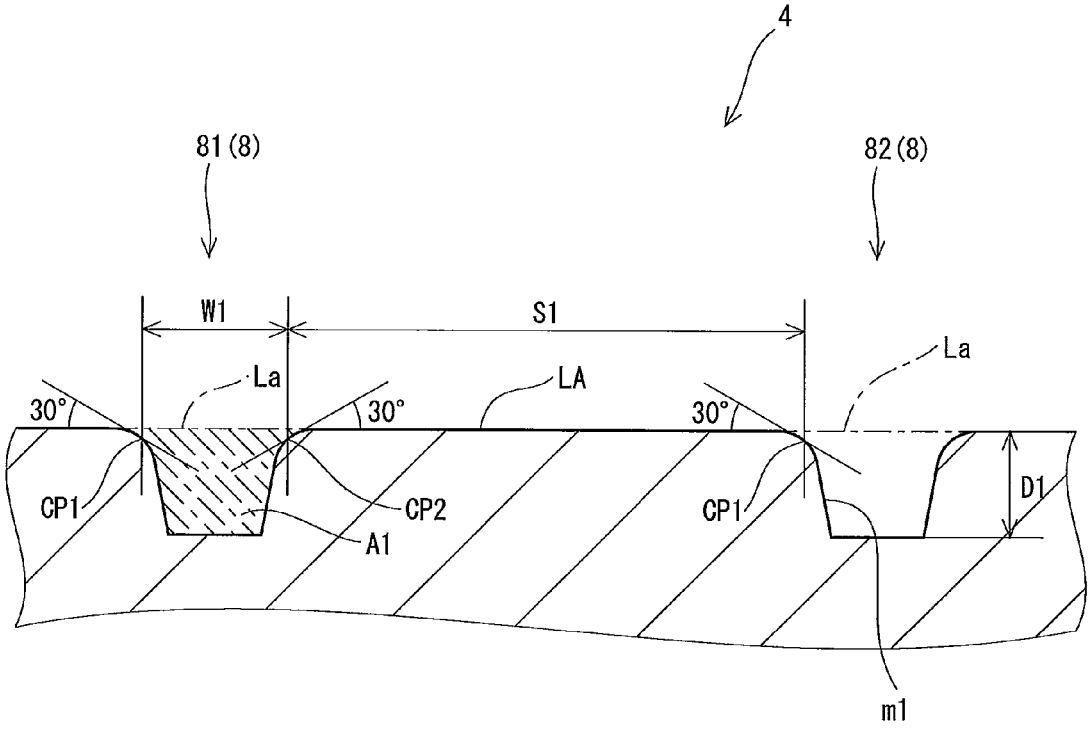
FIG. 6 is a diagram in which a part of a section taken along a line F6-F6 of FIG. 2 is expanded.

FIG. 6 is a sectional view taken along a line F6-F6 of FIG. 2. Two adjacent face lines 8 are drawn in the sectional view.

A groove width is shown by a double-pointed arrow W1 in FIG. 6. A groove distance is shown by a double-pointed arrow S1 in FIG. 6. An area of a transverse plane of the groove is shown by A1 in FIG. 6. The area A1 of the transverse plane of the groove is an area of a region shown by hatching of a one-dotted chain line.

The groove width W1 and the groove distance S1 are measured based on the golf rules defined by R&A (Royal and Ancient Golf Club of Saint Andrews). The measuring method is referred to as "30 degree method of measurement". The 30 degree method of measurement determines contact points CP1 and CP2 of a tangent having an angle of 30 degrees with respect to the land area LA and a groove. A distance between the contact point CP 1 and the contact point CP 2 is defined as the groove width W1 (see FIG. 6). A distance between the contact point CP 2 of the groove 81 and the contact point CP 1 of a groove 82 next to the groove 81 is defined as the groove distance S1 (see FIG. 6).

The groove depth D1 described above is a distance between an extended line La of the land area LA and the lowest point of the groove section line (see FIG. 6).

The groove area A1 is an area of a portion surrounded by the extended line La and the profile (section line) of the groove.

The golf rules related to the face line, including the new rules scheduled to be effected from Jan. 1, 2010 were announced from R&A (Royal and Ancient Golf Club of Saint Andrews) on Aug. 5, 2008. The Japanese translation of the rules of the face line is placed in the homepage of JGA (Japan Golf Association). The address of the JGA homepage in which the Japanese translation is posted is "http://www.j-ga.or.jp/jga/html/jga_data/04KISOKU_NEWS/2008_KISOKU/GrooveMeasurementProcedureOutline(JP).pdf". The rules are described in English in the rulebook (the 2009 edition) published by R&A (Royal and Ancient Golf Club of Saint Andrews) or the homepage of R&A. In the present application, the golf rules imply the rules defined by the R&A.

In respect of the spin performance, the groove width W1 is preferably equal to or greater than 0.20 (mm), more preferably equal to or greater than 0.25 (mm), and still more preferably equal to or greater than 0.30 (mm). In respects of the golf rules and of suppressing reduction in a flight distance caused by an excessive spin amount, the groove width W1 is preferably equal to or less than 0.889 (mm), more preferably equal to or less than 0.85 (mm), and still more preferably equal to or less than 0.80 (mm).

It is preferable that the groove distance S1 is set in consideration of the conformity to the golf rules. In respect of the conformity to the rules, it is preferable that a value obtained by dividing the area A1 by a groove pitch (groove width W1+distance S1) is equal to or less than 0.003 square inches/inch (0.0762 $mm^2$/mm). In respect of the conformity to the rules, it is preferable that the groove distance S1 is equal to or greater than three times the groove width W1.

Figure 7:
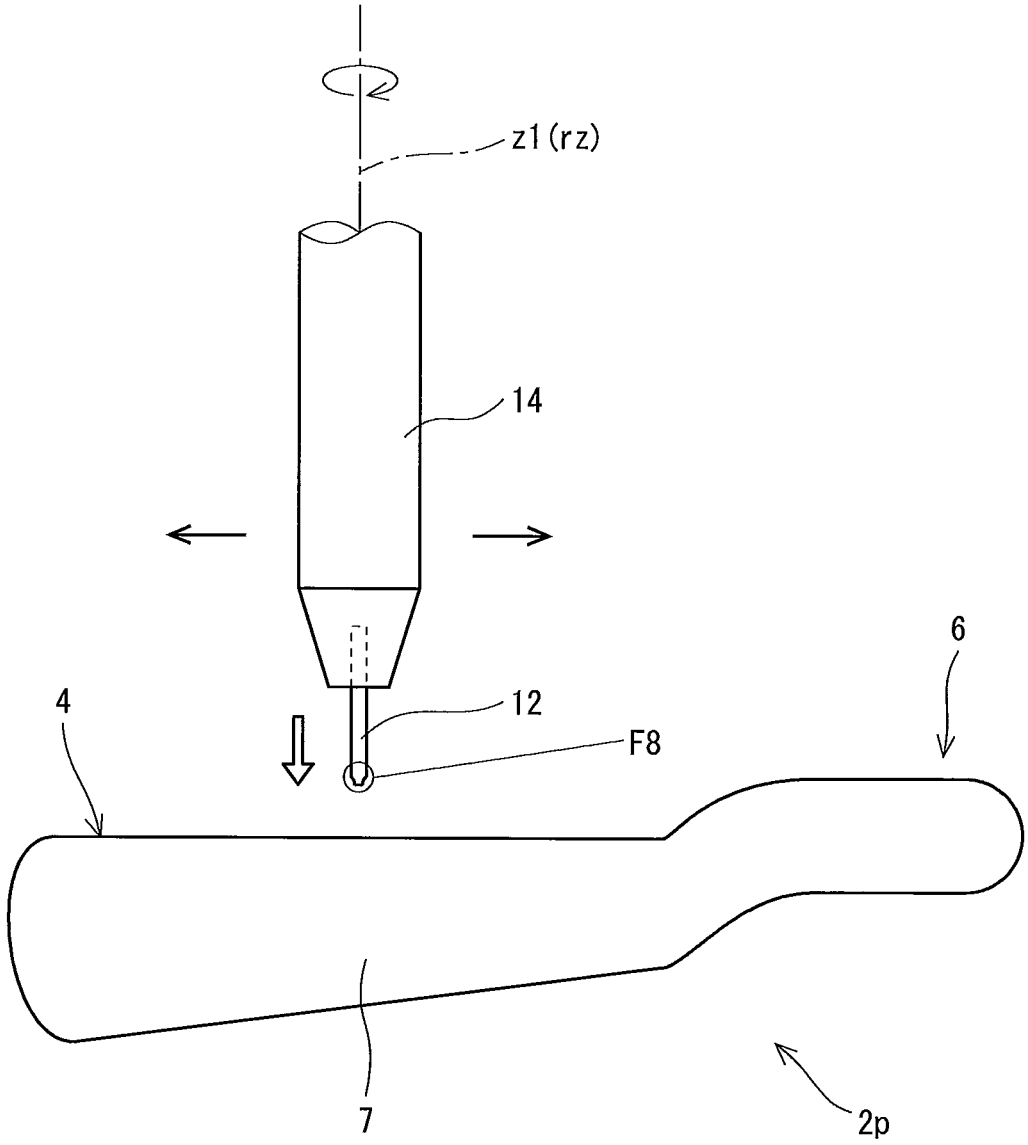
FIG. 7 is a diagram for explaining cut processing by a cutter.

An example of the preferred cut processing will be described below. FIG. 7 is a diagram for explaining an example of a step of processing the face line 8. The step can be conducted by, for example, using an NC processing machine. NC implies numerical control.

In the step, first, a head 2*p* before the face line 8 is formed is prepared. The head 2*p* is also referred to as a pre-line forming head. The pre-line forming head is an example of a pre-line forming member. As shown in FIG. 7, the head 2*p* is fixed with the face 4 horizontally set and faced upward. The head 2*p* is fixed by a jig, which is not shown.

In the step, the face line 8 is formed by cutting. The face line 8 is formed by a cutter 12 which is axially rotated.

As shown in FIG. 7, the cutter 12 is fixed to a base part 14. The base part 14 is a part of an NC processing machine (abbreviated in FIG. 7). The cutter 12 is rotated together with the base part 14. A rotation axis rz of the cutter 12 is equal to a central axis line z1 of the cutter 12.

The cutter 12 is axially rotated. The cutter 12 is moved while the axial rotation is maintained. The cutter 12 is moved to a predetermined cut starting position (a position of an end of the face line) (see arrows of FIG. 7). Next, the cutter 12 descends (see an open arrow of FIG. 7). A position in the vertical direction of the cutter 12 during processing is determined according to the depth of the face line 8 (the groove depth) previously set. Next, the cutter 12 is moved in the longitudinal direction (an almost toe-heel direction) of the face line (the arrows of FIG. 7). The movement follows a straight line. The face 4 is scraped during the movement to form the face line 8. Next, the cutter 12 ascends. The cutting is stopped concurrently with the ascending. Next, the cutter 12 is moved to a cut starting position of another face line 8. Hereinafter, these operations are repeated to process the plurality of face lines 8. The cutter 12 is moved based on a program memorized in the NC processing machine (not shown). The face line 8 having the designed depth is formed at the designed position.

A head obtained by combining a head body with a face plate has been known. In the head, the head body has an opening. The opening may be a recessed portion, or may be a through hole. The shape of the opening is equivalent to the contour shape of the face plate. In the head, the face plate is fitted into the opening. In the case of such a head, processing of the face line 8 may be carried out in the state of the simple face plate. The face plate before the processing of the face line is carried out is an example of the pre-line forming member.

Figure 8:
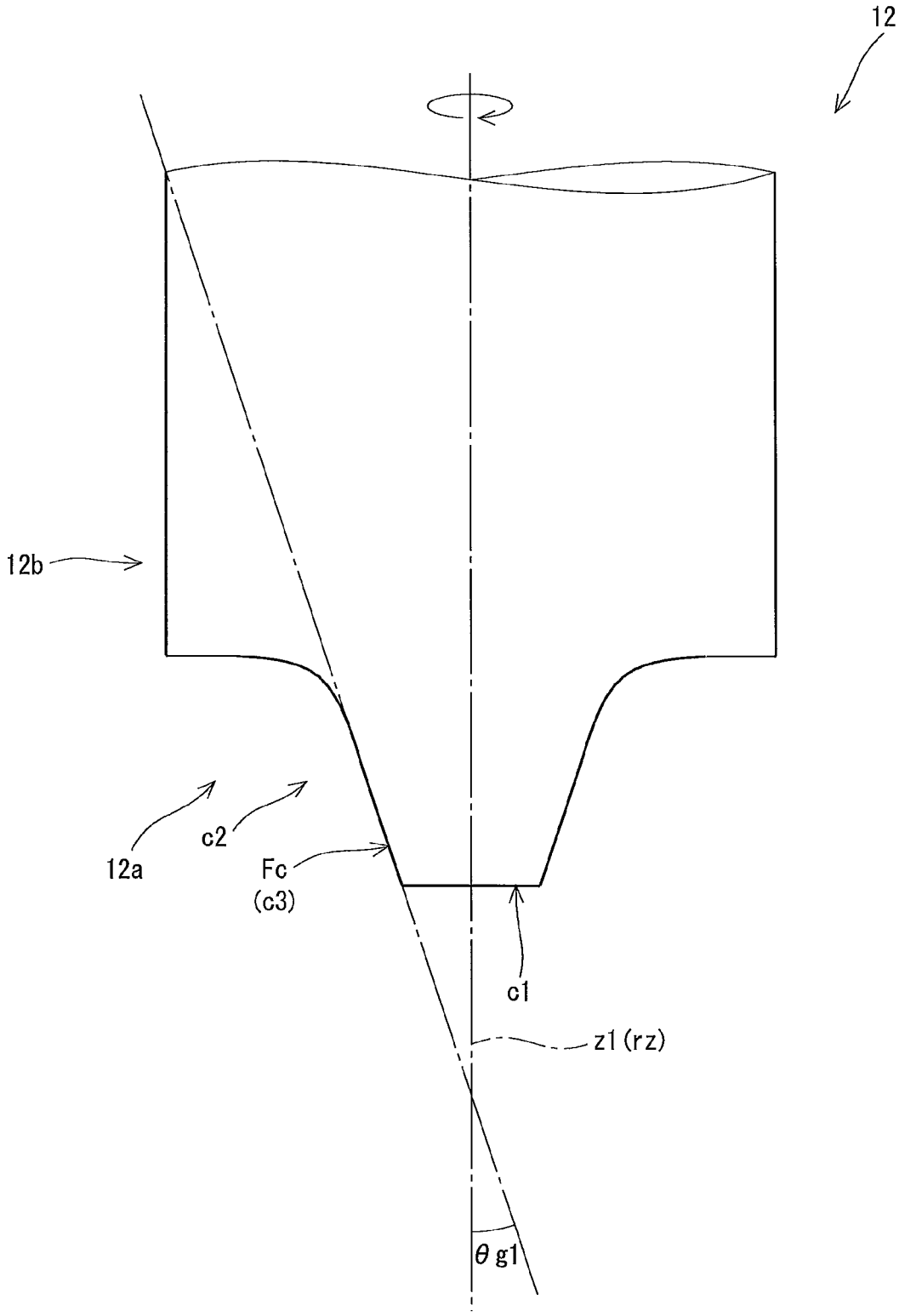
FIG. 8 is an enlarged view of a tip part of the cutter, and is a diagram of a portion shown by a circle F8 of FIG. 7.

FIG. 8 is an enlarged view of a tip part (see numeral character F8 in a circle of FIG. 7) of the cutter 12. The cutter 12 has a cutting surface 12*a* and a base body 12*b*. The base body 12*b* has a cylindrical shape. At least a part of the cutting surface 12*a* abuts on the head. At least a part of the cutting surface 12*a* scrapes the head. Usually, a part of the cutting surface 12*a* scrapes the head. The base body 12*b* has a cylindrical shape.

The section of the cutting surface 12*a* in a section perpendicular to the central axis line z1 has a circular shape. The section shape of the cutting surface 12*a* formed by a plane containing the central axis line z1 is equal to the shape of a side surface shown in FIG. 8.

As long as there is no especial explanation, "the section of the cutter" in the present application implies a section formed by a plane containing the central axis line z1. As long as there is no especial explanation, "the section of the face line" in the present application implies a section formed by a plane perpendicular to the land area LA and perpendicular to the longitudinal direction of the face line. An example of "the section of the face line" in the present application is a section taken along a line III-III of FIG. 2.

Figure 9:
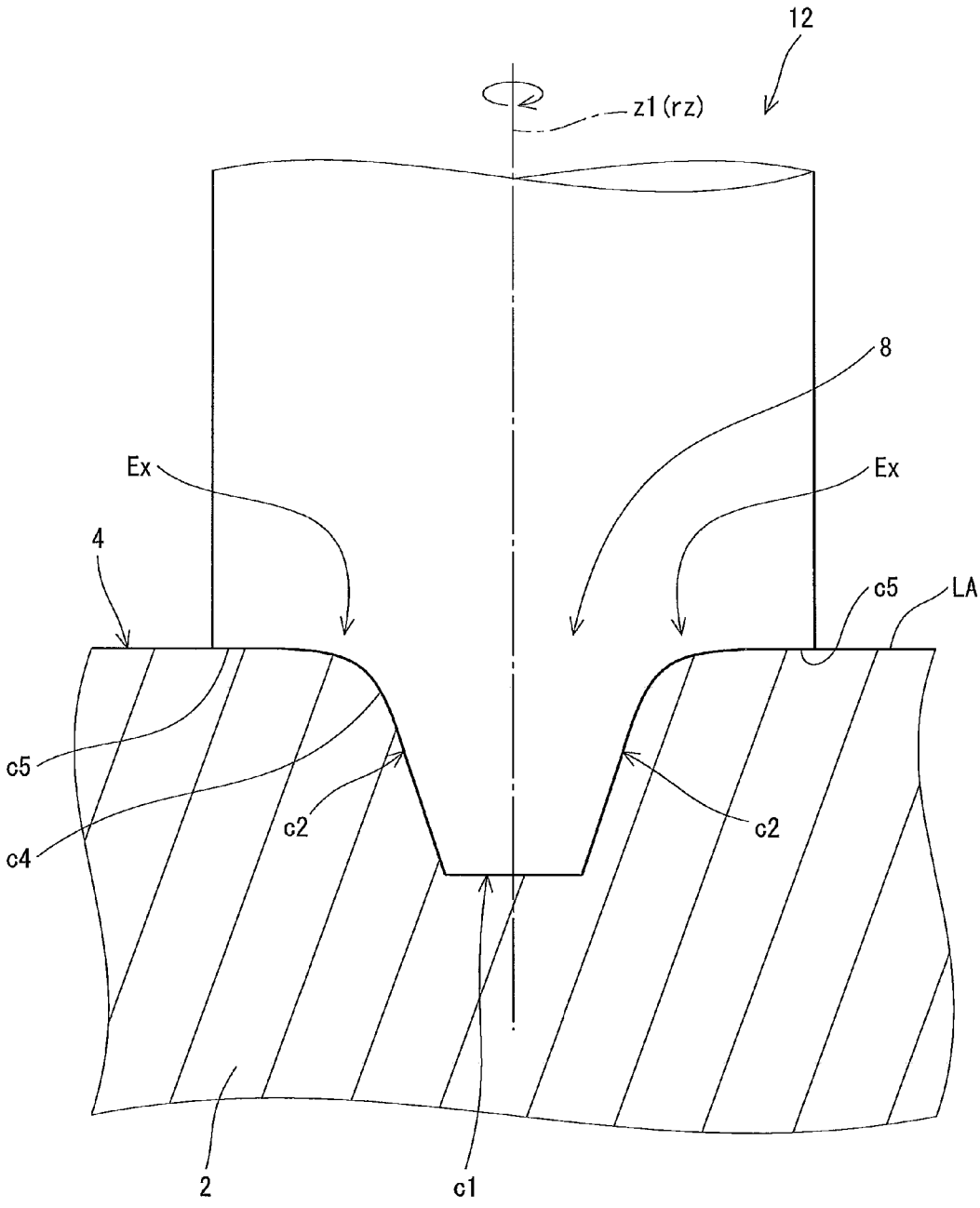
FIG. 9 is a diagram showing a condition in which cut processing is carried out by the cutter shown in FIG. 8.

FIG. 9 is a partial sectional view showing a condition during the cut processing. The face line 8 having the section shape corresponding to the cutting surface 12*a* is formed by the cut processing. In the embodiment of FIG. 9, the central axis line z1 is perpendicular to the land area LA.

As shown in FIG. 9, the bottom surface gc1 of the face line 8 is scraped by the bottom surface c1. The plane inclined part gc3 of the face line 8 is scraped by a conical surface Fc (first straight part c3). The protruded curved surface gc4 of the face line 8 is scraped by the recessed curved surface c4.

In the embodiment of FIG. 9, in a direction of the central axis line z1 (a direction perpendicular to the land area LA), the position of the land area LA coincides with the position of the upper side plane part c5. In the embodiment of FIG. 9, the vertical position of the land area LA coincides with the vertical position of the upper side plane part c5. The land area LA is brought into surface-contact with the upper side plane part c5. The upper side plane part c5 is a reference for positioning the cutter 12. The cutter 12 is positioned so that the upper side plane part c5 abuts on the land area LA. Unlike the embodiment of FIG. 9, a clearance may be formed between the upper side plane part c5 and the land area LA. In this case, the cutter 12 is positioned based on the distance of the clearance. The upper side plane part c5 can enhance the position accuracy of the depth-directional position of the cutter 12. The upper side plane part c5 enables the processing of high accuracy.

Figure 10:
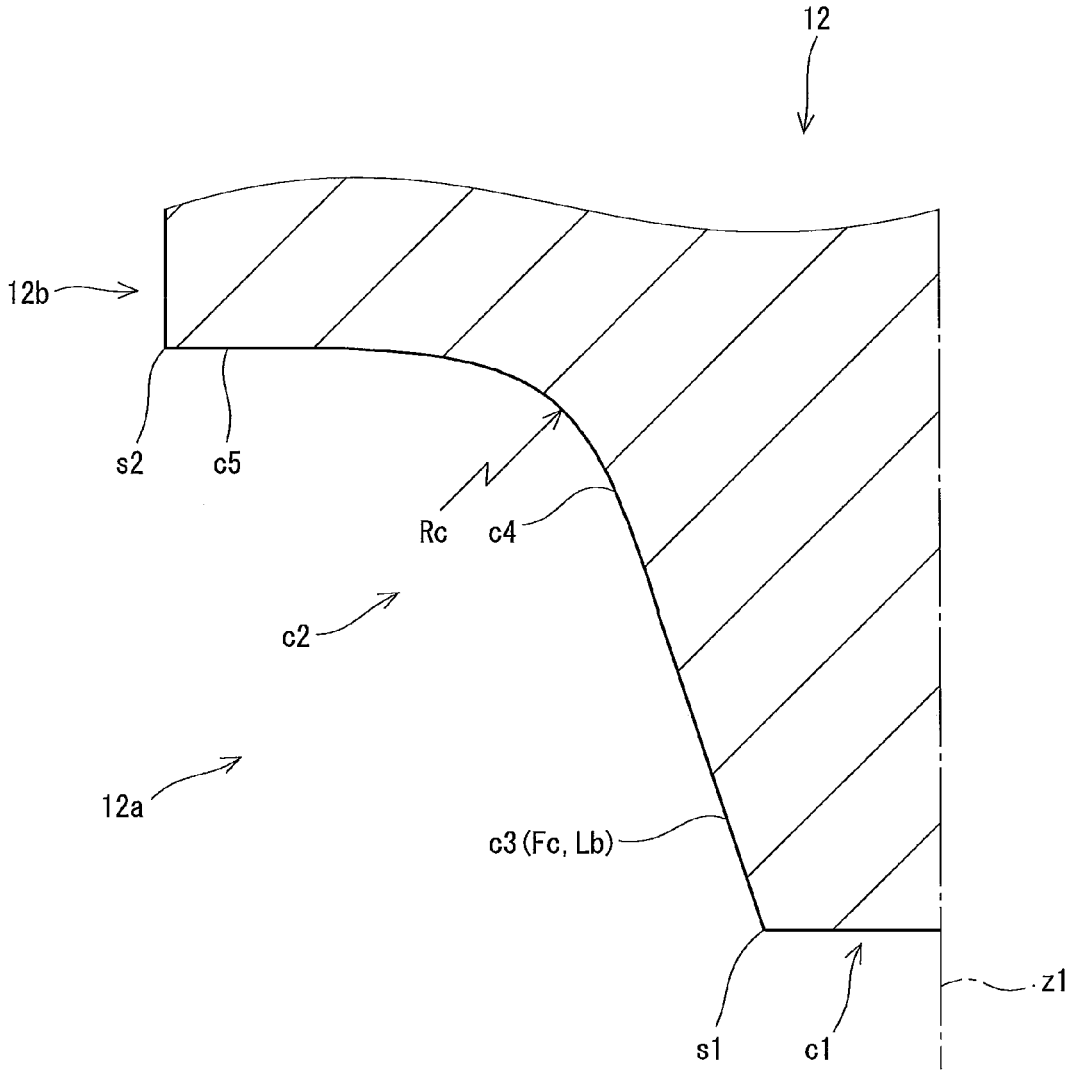
FIG. 10 is a partial sectional view of the cutter shown in FIG. 8.
Figure 11:
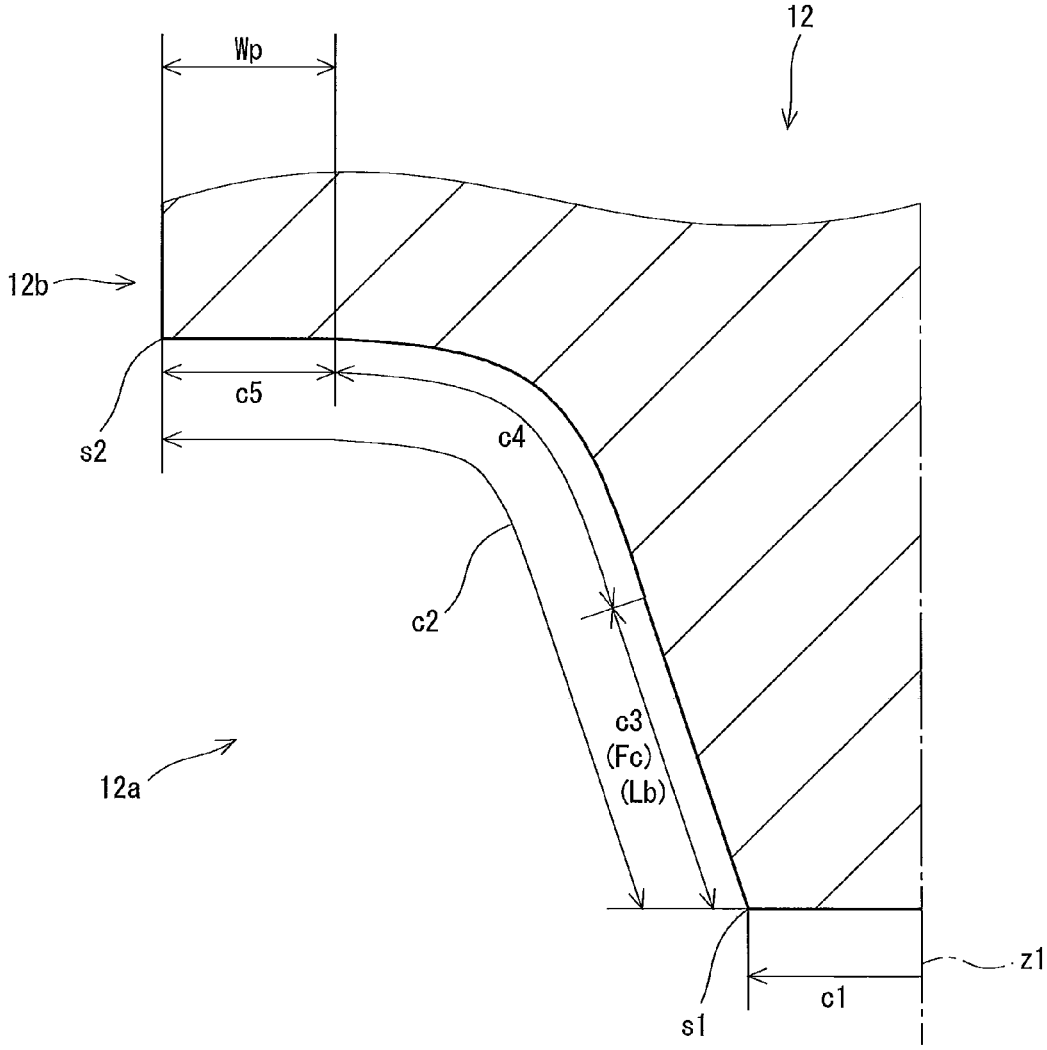
FIG. 11 is a partial sectional view of the cutter shown in FIG. 8 as in FIG. 10.

FIGS. 10 and 11 are sectional views of the tip part of the cutter 12. FIGS. 10 and 11 are sectional views formed by a plane containing the central axis line z1. The sectional view of the cutter 12 is axisymmetric about the central axis line z1. Accordingly, only the left side of the central axis line z1 is shown in FIGS. 10 and 11.

As shown in FIGS. 10 and 11, the cutting surface 12*a* has a bottom surface c1 and a side surface c2. The side surface c2 is located between the base body 12*b* and the bottom surface c1. A boundary between the bottom surface c1 and the side surface c2 is a corner s1. A boundary between a side surface of the base body 12*b* and the side surface c2 is a corner s2.

As shown in FIG. 11, the side surface c2 has a first straight part c3, a curved line part c4, and a second straight part c5. In the cutter 12 of the embodiment, the bottom surface c1 is a plane. In the cutter 12, the bottom surface c1 is a circular plane. The plane is perpendicular to the central axis line z1. The shape of the bottom surface c1 is not restricted. The bottom surface c1 may be a curved surface. The bottom surface c1 may not be perpendicular to the central axis line z1. The bottom surface c1 may be an uneven surface. In respect of enlarging an area A1 (described later) of a transverse plane of the face line 8, the bottom surface c1 is preferably a plane, and more preferably a plane perpendicular to the central axis line z1.

The section of the first straight part c3 is a straight line. The first straight part c3 is a conical surface Fc. The first straight part c3 is a conical protruded surface. The section line of the conical surface Fc is a straight line. The section line of the conical surface Fc is a generating line Lb of the conical surface Fc. The boundary between the conical surface Fc and the bottom surface c1 is the corner s1. In the embodiment, the corner s1 has no roundness. The corner s1 may have a roundness.

The first straight part c3 is also referred to as the conical surface Fc. The conical surface Fc may not be formed. For example, the entire side surface c2 may be the curved line part c4. Comprehensively considering the manufacturing cost of the cutter, the cost of the cut processing, the securement of the area A1 (described later) of the transverse plane of the groove, and the conformity to the golf rules, it is preferable that the conical surface Fc is formed.

The curved line part c4 is a recessed surface. The recessed surface is a recessed curved surface. The entire recessed curved surface is smoothly continuously formed. The curved line part c4 is also referred to as a recessed curved surface c4. The section of the recessed curved surface c4 is a curve. The shape of the curve is recessed. In other words, the shape of the curve is a protruded shape toward the central axis line z1.

In the preferred embodiment, the protruded curved surface gc4 is formed by the recessed curved surface c4. More specifically, the cut processing by the recessed curved surface c4 forms the protruded curved surface gc4. A section shape of the recessed curved surface c4 corresponds to the section shape of the protruded curved surface gc4. The protruded curved surface gc4 has a curvature radius Rc corresponding to the curvature radius Ra described above.

The face line having the edge having a roundness can be produced with sufficient accuracy by the cut processing using the cutter 12.

The second straight part c5 is a plane. The second straight part c5 is also referred to as an upper side plane part c5. The upper side plane part c5 is a plane part of an upper end of the side surface c2. The upper side plane part c5 is a plane perpendicular to the central axis line z1. The upper side plane part c5 is an annular plane. The upper side plane part c5 is located between the surface of the base body 12*b* and the recessed curved surface c4. The boundary between the surface of the base body 12*b* and the upper side plane part c5 is the corner s2 (see FIG. 11).

The conical surface Fc and the recessed curved surface c4 are smoothly continuously formed. The recessed curved surface c4 and the upper side plane part c5 are smoothly continuously formed. The entire side surface c2 is smoothly continuously formed. The side surface c2 may have a portion which is not smoothly continuously formed.

A width of the upper side plane part c5 is shown by a double-pointed arrow Wp in FIG. 11. The width Wp is measured along the radial direction of the cutter 12. In respect of the processing accuracy, the width Wp is preferably equal to or greater than 0.1 mm, and more preferably equal to or greater than 0.3 mm. In respect of reducing the manufacturing cost of the cutter 12, the width Wp is preferably equal to or less than 5 mm, more preferably equal to or less than 3 mm, and still more preferably equal to or less than 1 mm.

The upper side plane part c5 may not be present. As described above, in respect of the processing accuracy, it is preferable that the upper side plane part c5 is present.

The edge Ex is formed as a smooth curved surface by the cut processing with the upper side plane part c5 abutting on the land area LA. The smooth curved surface is hard to damage the ball.

According to the embodiment of FIG. 9, the face line 8 having the edge Ex to which a roundness is applied is formed by the recessed curved surface c4. Since the edge Ex having the roundness applied by the cut processing is formed, it is not necessary to carrying out the step of rounding the edge after the cut processing.

An angle between the central axis line z1 and the conical surface Fc (first straight part c3) is shown by θg1 in FIG. 8. The angle θg1 is measured in a section formed by a plane containing the central axis line z1. In the present application, the angle θg1 is also referred to as an edge angle.

In respect of setting the groove angle θm to the preferred value, the edge angle θg1 is preferably equal to or greater than 40 degrees, more preferably equal to or greater than 42 degrees, and still more preferably equal to or greater than 44 degrees. In respect of setting the groove angle θm to the preferred value, the edge angle θg1 is preferably equal to or less than 70 degrees, more preferably equal to or less than 68 degrees, and still more preferably equal to or less than 66 degrees.

As the groove angle θm is smaller, the ball is apt to be damaged. Therefore, as the groove angle θm is smaller, the radius R3 may be increased to suppress the damage of the ball. In this respect, preferably, the groove angle θm (degree) and the radius R3 (mm) satisfy the following formula (F1), and more preferably satisfy the following formula (F2).

$$R3 \geqq -0.002 \times \theta m + 0.14 \quad \text{(F1)}$$

$$R3 \geqq -002 \times \theta m + 0.16 \quad \text{(F2)}$$

When the groove angle θm is large, the dischargeability of water and the dischargeability of earth and sand tend to be enhanced. Therefore, in this case, in the sand shot, the duffing shot, and the shot in the wet condition, the spin performance can be enhanced. On the other hand, when the groove angle θm is large, an edge effect may be reduced to reduce synthetic spin performance. In these respects, it is preferable that the radius R3 is reduced to enhance the edge effect as the groove angle θm is larger. In this respect, preferably the groove angle θm (degree) and the radius R3 (mm) satisfy the following formula (F3), and more preferably satisfy the following formula (F4).

$$R3 \leqq -0.002 \times \theta m + 0.20 \quad \text{(F3)}$$

$$R3 \leqq -0.002 \times \theta m + 0.18 \quad \text{(F4)}$$

EXAMPLES

Hereinafter, the effects of the present invention will be clarified by examples. However, the present invention should not be interpreted in a limited way based on the description of the examples.

Example 1

A head having no face lines was produced by casting. A material of the head was stainless steel. The real loft angle of the head was set to 56 degrees. The head is a so-called wedge. The face lines were formed on the head.

The face lines were formed by cut processing in the method described with reference to FIG. 7. However, a shape of a tip part of a cutter was simplified.

Figure 12:
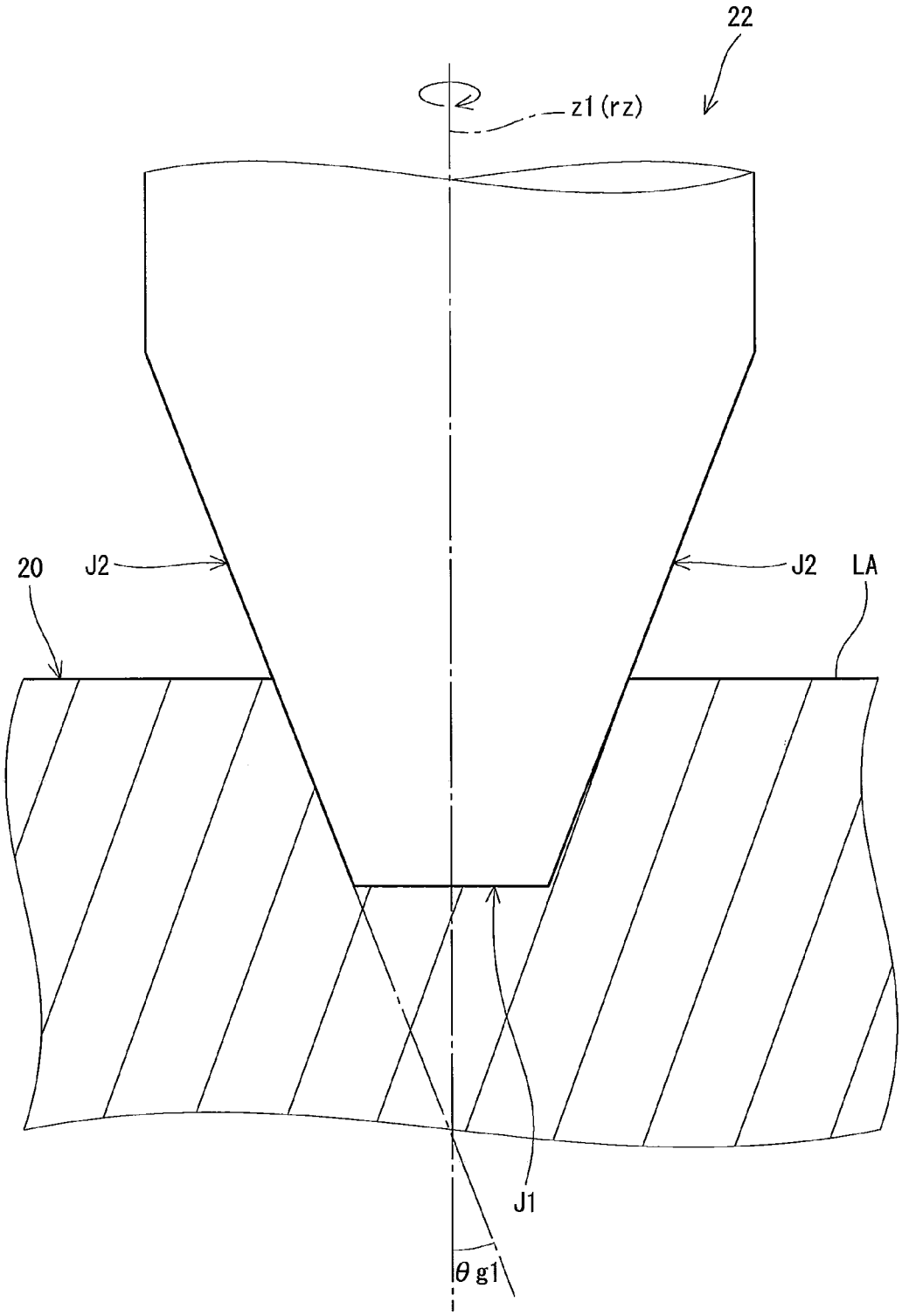
FIG. 12 is a diagram showing a condition in which a face line is cut in examples and comparative examples.

FIG. 12 is a diagram showing a condition of cut processing of the face line in example 1. More specifically, FIG. 12 is a partial sectional view showing a condition in which a face line 24 is formed on a face 20 by cut processing. In the example 1, a cutting surface of a cutter 22 has no recessed curved surface. The cutting surface of the cutter 22 has a bottom surface J1 and a conical surface J2. The cutting surface of the cutter 22 is constituted by only the bottom surface J1 and the conical surface J2. The bottom surface J1 is a circular plane. A central axis line z1 of the cutter 22 passes through the center of the bottom surface J1. The bottom surface J1 is a plane perpendicular to the central axis line z1. The section shape of the conical surface J2 is a straight line. The straight line is a generating line of the conical surface J2. In the cutter 22, an edge angle θg1 and a groove angle θm were set to 40 degrees.

Figure 13:
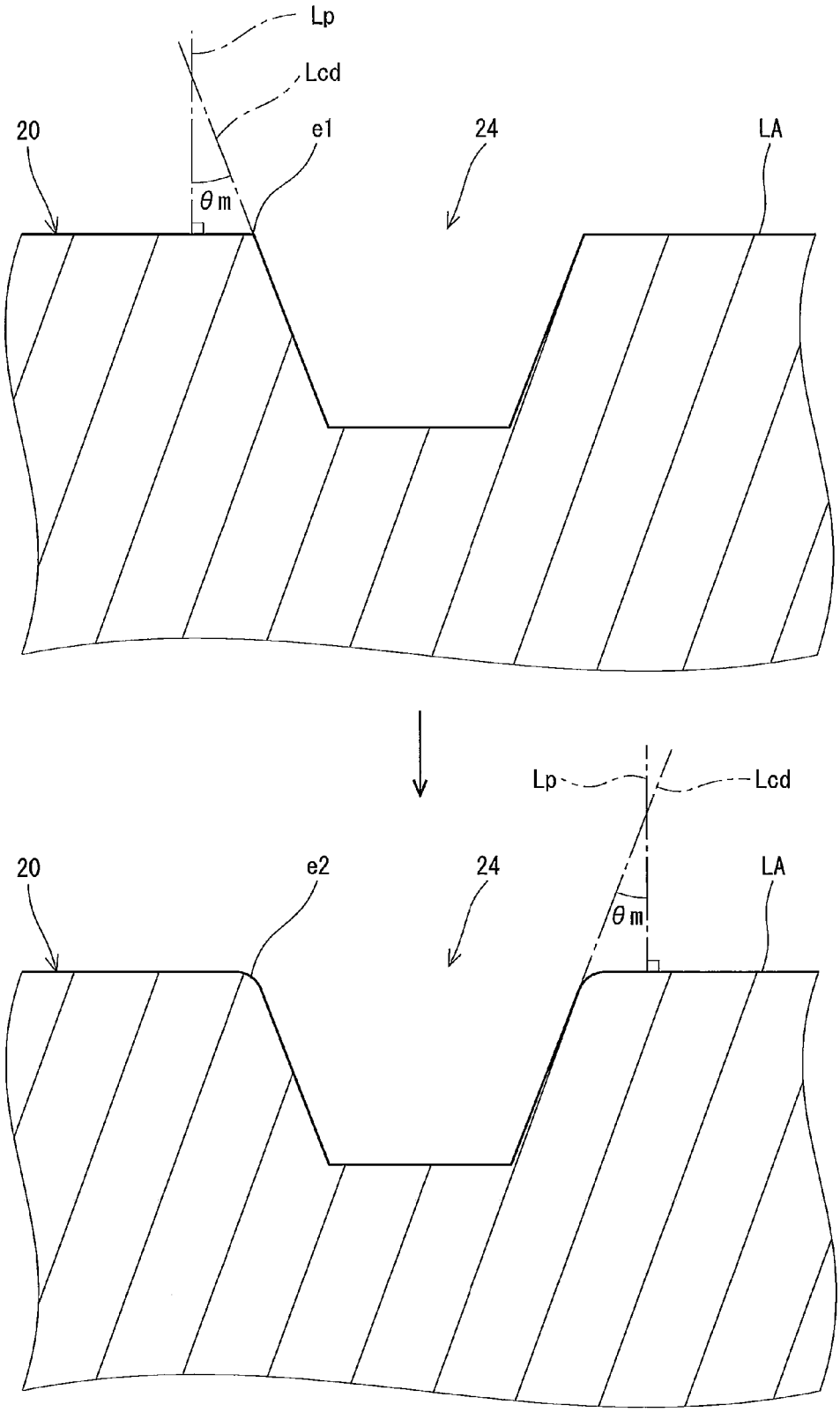
FIG. 13 is a diagram for explaining processing for rounding an edge carried out in examples and comparative examples.

FIG. 13 is a diagram for explaining the step of the example 1. An upper side view of FIG. 13 is a sectional view of the face line 24 formed by cut processing using the cutter 22. Immediately after the cut processing, an edge e1 of the face line 24 had no roundness.

Next, polishing (buffing) was carried out in order to apply a roundness to the edge e1 of the face line 24. A wire buff was carried out in order to apply the roundness. In the wire buff, a wire brush having a disk shape as a whole was used. The buffing was carried out by forcing the face surface on the peripheral face of the disk-shaped brush while the brush was rotated. In the disk-shaped brush, a large number of wires extending toward the outer side of the radial direction from the center of the brush are planted. The set of the end faces of the large number of wires forms the peripheral face of the brush. The face surface was brought into contact with the peripheral face of the brush to carry out wire buffing while the brush is rotated at 1500 rpm. A roundness was applied to the edge e1 by the wire buffing. More specifically, the edge e1 (see the upper side diagram of FIG. 13) having no roundness was processed to the edge e2 (see the lower side diagram of FIG. 13) having the roundness by the wire buffing. Thus, the face line 24 according to the example 1 was obtained.

The face lines 24 were disposed as in the face lines 8 shown in FIGS. 1 and 2. A distance Ed (see FIG. 2) between the heel side end of the non-longest line and the edge of a face was set to 5 mm. The shortest distance between a heel side end Bh1 (see FIG. 2) of the face line closest to a sole and a leading edge Le was set to 2 mm. The shortest distance between a toe side end Bt1 (see FIG. 2) of the face line closest to the sole and the leading edge Le was set to 2 mm. The shortest distance between a center position Ac1 in a longitudinal direction of the face line closest to the sole and the leading edge Le was set to 4.5 mm. The length of the shortest face line was set to be equal to or greater than 5 (mm). A distance Ky (see FIG. 2) between a point Tt1 closest to the toe side on a face surface and the straight line Lt1 was set to 17 mm.

The section shape of the face line was measured. "INFINITE FOCUS optical 3D Measurement Device G4f" (trade name) manufactured by Alicona Imaging GmbH was used for the measurement. The shape of the face line was measured along a direction perpendicular to the longitudinal direction of the face line. The section shape was measured at the center position of the longest line as in the position of line of FIG. 2.

Fourteen face lines were measured. As a result, fourteen section lines were obtained. The average value of fourteen data obtained from the section lines is shown in the following Table 1. A groove width W1 and a groove depth D1 were determined according to the golf rules. A radius R3 was 0.10 (mm). A groove angle θm was 40 degrees. The groove depth D1 was set to be equal to or less than 0.30 (mm). A groove distance S1 was set to 2.9 (mm). The maximum distance Zm was 0.03 mm.

A shaft and a grip were mounted to the head body to obtain a golf club according to example 1. The length of the golf club was 35 inches. Dischargeability of earth and sand, dischargeability of water, and damage of a ball (damage applied to the ball) for the golf club were evaluated. The specification and the evaluation result of the example 1 are shown in the following Table 1.

Examples 2 and 3 and Comparative Examples 1 to 5

Heads of examples 2 and 3, and comparative examples 1 to 5 were obtained in the same manner as in the example 1 except that the shape of the cutter was changed and shape of the groove was set so as to satisfy values shown in Table 1. These specifications and evaluation results are shown in the following Table 1.

The shape of the cutter was set to a shape shown in FIG. 12 in all the examples and all the comparative examples. In all the examples and all the comparative examples, a cutter having a cutting surface constituted by only a bottom surface J1 and a conical surface J2 was used.

A valuation method is as follows. A golf ball used in the following evaluations is "SRIXON Z-STAR" (trade name) manufactured by SRI Sports Limited.

[Evaluation of Dischargeability of Earth and Sand]

Each of ten testers hit balls placed on a bunker with full shots, and the backspin rates of the balls immediately after hitting were measured. The testers had a head speed of a driver of 44 (m/s) or greater and 46 (m/s) or less. One tester hit five balls per each of the clubs. In hitting the ball, the ball was set to a condition in which the lowest point of the ball sank by 15 (mm) from the surface of sand around the ball. The balls were hit in the condition to duff all the shots. The average value of the backspin rates of all the hit balls (number of data: 50) is shown in the following Table 1. The average value is rounded off to the nearest ten. As the backspin rate is greater, the dischargeability of earth and sand is higher and good.

[Evaluation of Dischargeability of Water]

Each of ten testers hit balls placed on a grass with full shots, and the backspin rates of the balls immediately after hitting were measured. One tester hit five balls per each of the clubs. A face surface was wet with water in an address, and the shot was immediately carried out. The average value of the backspin rates of all the hit balls (number of data: 50) is shown in the following Table 1. The average value is rounded off to the nearest ten. As the backspin rate is greater, the dischargeability of water is higher and good.

[Evaluation of Ball Damage]

Each of ten testers hit balls placed on a grass with full shots, and the damages of the balls produced by the shots were visually confirmed. Balls having dimples which were damaged were estimated as "NG". Balls having dimples which were not damaged were estimated as "OK". The evaluation results are shown in the following Table 1.

TABLE 1

Specifications and Evaluation Results of Examples and Comparative Examples

| | Example 1 | Example 2 | Example 3 | Comparative Example 1 | Comparative Example 2 | Comparative Example 3 | Comparative Example 4 | Comparative Example 5 |
|---|---|---|---|---|---|---|---|---|
| Real loft angle (degree) | 56 | 56 | 56 | 56 | 56 | 56 | 56 | 56 |
| Curvature radius R3 (mm) | 0.10 | 0.08 | 0.02 | 0.15 | 0.40 | 0.20 | 0.10 | 0.20 |
| Maximum distance Zm (mm) | 0.03 | 0.04 | 0.05 | 0.06 | 0.07 | 0.065 | 0.03 | 0.05 |
| Groove angle θ m (degree) | 40 | 45 | 70 | 30 | 80 | 40 | 20 | 80 |
| Groove width W1 (mm) | 0.70 | 0.70 | 0.70 | 0.70 | 0.70 | 0.70 | 0.70 | 0.70 |
| Groove distance S1 (mm) | 2.9 | 2.9 | 2.9 | 2.9 | 2.9 | 2.9 | 2.9 | 2.9 |
| Dischargeability of earth and sand (rpm) | 6500 | 6800 | 6250 | 6900 | 5800 | 6150 | 6950 | 6000 |
| Dischargeability of water (rpm) | 6300 | 6500 | 6200 | 6800 | 5600 | 6300 | 6850 | 5900 |
| Evaluation of ball damage | OK | OK | OK | NG | OK | OK | NG | OK |

As shown in Table 1, the examples are highly evaluated as compared with the comparative examples. In the examples, both two kinds of backspin rates are more than 6200 rpm, and the damage of the ball is evaluated as "OK". In the comparative examples, at least any one of two kinds of backspin rates is less than 6200 rpm, or the damage of the ball is evaluated as "NG".

The present invention can be applied to all the golf club heads provided with the face lines. The present invention can be used for an iron type golf club head, a wood type golf club head, a utility type golf club head, a hybrid type golf club head, a putter type golf club head, or the like.

The description hereinabove is merely for an illustrative example, and various modifications can be made in the scope not to depart from the principles of the present invention.

What is claimed is:

1. A golf club head comprising a face line having a depth of D1 (mm) and a land area, wherein when a boundary between the land area and the face line in a section line of a surface of the face line is defined as a point Pa; a point of which a depth is [D¼] (mm) is defined as a point Pb; a point of which a depth is [D½] (mm) is defined as a point Pc; a point of which a depth is [(D1)×(¾)] (mm) is defined as a point Pd; a radius of a circle CL1 passing through three points of the point Pa, the point Pb, and the point Pc is defined as R3 (mm); a straight line passing through the point Pc and the point Pd is defined as a straight line Lcd; a straight line perpendicular to the land area is defined as a straight line Lp; and an angle between the straight line Lcd and the straight line Lp is defined as θm, the radius R3 is 0.01 (mm) or greater and 0.10 (mm) or less, and the angle θm is 40 degrees or greater and 70 degrees or less.

2. The golf club head according to claim 1, wherein the section line is smoothly continuously formed between the point Pa and the point Pd.

3. The golf club head according to claim 1, wherein a maximum value Zm of a deviation distance between the section line of the point Pa to the point Pc and the circle CL1 is equal to or less than 0.05 mm.

4. The golf club head according to claim 1, wherein the radius R3 is equal to or less than 0.090 (mm).

5. The golf club head according to claim 1, wherein the radius R3 is equal to or less than 0.080 (mm).

6. The golf club head according to claim 1, wherein an angle θ1 between a tangent at the point Pa and the land area is equal to or less than 30 degrees.

7. The golf club head according to claim 1, wherein an angle θ2 between a tangent Le 1 of the circle CL1 at the point Pa and the land area LA is equal to or less than 30 degrees.

8. The golf club head according to claim 1, wherein a curvature radius Ra at each of points between the point Pa and the point Pc is constant.

9. The golf club head according to claim 1, wherein a curvature radius Ra at each of points between the point Pa and the point Pc is not constant.

10. The golf club head according to claim 1, wherein a straight line portion is included between the point Pa and the point Pc.

11. The golf club head according to claim 1, wherein only a curved line is included between the point Pa and the point Pc.

12. The golf club head according to claim 1, wherein a curvature radius Ra at each of points between the point Pb and the point Pc is constant.

13. The golf club head according to claim 1, wherein a curvature radius Ra at each of points between the point Pb and the point Pc is not constant.

14. The golf club head according to claim 1, wherein a straight line portion is included between the point Pb and the point Pc.

15. The golf club head according to claim 1, wherein a curvature radius Ra at each of points between the point Pc and the point Pd is constant.

16. The golf club head according to claim 1, wherein a straight line portion is included between the point Pc and the point Pd.

17. The golf club head according to claim 1, wherein only a straight line is included between the point Pc and the point Pd.

18. The golf club head according to claim 1, wherein at least one of a straight line and/or a curved line is smoothly continuously formed between the point Pa and the point Pd.

19. The golf club head according to claim 1, wherein a groove width W1 is 0.20 mm or greater and 0.889 mm or less.

20. The golf club head according to claim 1, wherein the face line is formed using a cutter rotated about an axis line z1;

a cutting surface of the cutter has a conical surface; and an angle θg1 between the axis line z1 and the conical surface is 40 degrees or greater and 70 degrees or less.

21. The golf club head according to claim 1, wherein the groove angle θm (degree) and the radius R3 (mm) satisfy the following formula (F1):

$$R3 \geqq -0.002 \times \theta m + 0.14 \quad \text{(F1).}$$

22. The golf club head according to claim 1, wherein the groove angle θm (degree) and the radius R3 (mm) satisfy the following formula (F2):

$$R3 \geqq -0.002 \times \theta m + 0.16 \quad \text{(F2)}.$$

23. The golf club head according to claim 1, wherein the groove angle θm (degree) and the radius R3 (mm) satisfy the following formula (F3):

$$R3 \leqq -0.002 \times \theta m + 0.20 \quad \text{(F3)}.$$

24. The golf club head according to claim 1, wherein the groove angle θm (degree) and the radius R3 (mm) satisfy the following formula (F4):

$$R3 \leqq -0.002 \times \theta m + 0.18 \quad \text{(F4)}.$$

* * * * *

UNITED STATES PATENT AND TRADEMARK OFFICE

CERTIFICATE OF CORRECTION

PATENT NO. : 8,444,503 B2
APPLICATION NO. : 12/766750
DATED : May 21, 2013
INVENTOR(S) : Tomio Kumamoto It is certified that error appears in the above-identified patent and that said Letters Patent is hereby corrected as shown below:

ON THE TITLE PAGE:

At item (45), Date of Patent, change "May 21, 2013" to -- *May 21, 2013 --.

At item (*), Notice, insert the following new paragraph:

-- This patent is subject to a terminal disclaimer. --.

Signed and Sealed this
Twenty-fourth Day of September, 2013

Teresa Stanek Rea
*Deputy Director of the United States Patent and Trademark Office*